US006851584B2

(12) United States Patent
White

(10) Patent No.: US 6,851,584 B2
(45) Date of Patent: Feb. 8, 2005

(54) LIQUID-POURERS

(75) Inventor: Matthew Edward Thomas White, Haywards Heath (GB)

(73) Assignee: Teamstudy Consultants Limited, Haywards Heath (GB)

( * ) Notice: Subject to any disclaimer, the term of this patent is extended or adjusted under 35 U.S.C. 154(b) by 0 days.

(21) Appl. No.: 10/312,368

(22) PCT Filed: Jun. 26, 2001

(86) PCT No.: PCT/GB01/02866

§ 371 (c)(1),
(2), (4) Date: Dec. 23, 2002

(87) PCT Pub. No.: WO02/00519

PCT Pub. Date: Jan. 3, 2002

(65) Prior Publication Data

US 2003/0106909 A1 Jun. 12, 2003

(30) Foreign Application Priority Data

Jun. 27, 2000 (GB) ..... 0015599

(51) Int. Cl.[7] ..... B67D 3/00
(52) U.S. Cl. ..... 222/475; 222/481.5
(58) Field of Search ..... 222/468, 475, 222/481.5

(56) References Cited

U.S. PATENT DOCUMENTS 2,662,670 A * 12/1953 August ..... 222/478
2,898,014 A * 8/1959 Borah ..... 222/481.5
5,104,010 A * 4/1992 Codorniz et al. ..... 222/475
5,487,482 A 1/1996 Rocheleau ..... 215/396
5,605,254 A * 2/1997 Wagner et al. ..... 222/108
6,105,831 A * 8/2000 Finezilber ..... 222/475
6,155,464 A * 12/2000 Vachon ..... 222/484
6,230,944 B1 * 5/2001 Castellano et al. ..... 222/481.5
6,364,176 B1 * 4/2002 Kilian ..... 222/468
2003/0111493 A1 * 6/2003 Kao ..... 222/481.5

FOREIGN PATENT DOCUMENTS

| | | |
|---|---|---|
| DE | 1172138 | 8/1964 |
| FR | 2134285 | 12/1972 |
| GB | 821769 | 10/1959 |
| GB | 2343443 | 5/2000 |
| WO | 95/32127 | 11/1995 |
| WO | 96/27529 | 9/1996 |

* cited by examiner

*Primary Examiner*—Joseph A. Kaufman
(74) *Attorney, Agent, or Firm*—Davis & Bujold, P.L.L.C.

(57) ABSTRACT

A liquid-pourer of molded plastics has a spout-portion (1, 17) with a spigot (7, 18) for insertion into a neck (11, 20) of a bottle (10, 19) for pouring liquid from it. Two complimentary segmental passageways (4, 5) extend lengthwise through the cylindrical spout-portion (1, 17) for discharge of liquid and admission of air to the bottle (10, 19) respectively. An elongate handle-portion (2, 24) extends both upwardly and rearwardly from the spout-portion (1, 17) to overlie the bottle (10, 19) to allow balance in holding it with the air passageway (5) above the pouring passageway (4). A ring (6) on the handle-portion (2) retains the cap of the bottle (10), and the spout-portion (1, 17) is attached to the bottle-neck (11, 20) by a screw-threaded collar (8), or a spring clip (15 FIG. 5).

15 Claims, 3 Drawing Sheets

LIQUID-POURERS

FIELD OF THE INVENTION

This invention relates to liquid-pourers.

BACKGROUND OF THE INVENTION

According to the present invention a liquid-pourer for attachment to the neck of a bottle, comprises a spout-portion having a rear end for coupling to the bottle-neck and two elongate passageways extending parallel to one another between the rear and front ends of the spout-portion to open into and from the bottle, a first of the passageways being operative for discharging liquid in pouring from the bottle and the second passageway being operative for admitting air to the bottle when the second passageway is located above the first during pouring, and an elongate handle-portion attached to the spout-portion to extend both upwardly and rearwardly to overlie the bottle when the second passageway is above the first during pouring as aforesaid.

The spout-portion, which may have a spigot at its rear end for entry into the bottle-neck, may be generally cylindrical in the latter case, the two passageways may be of complementary segmental cross-section and extend parallel to one another lengthwise of the spout-portion.

The liquid-pourer according to the invention may include means for screw-thread attachment of the spout-portion to the neck of the bottle. Alternatively, it may include to the same end, a resilient clip-element for snap engagement under a portion of the neck of the bottle.

SUMMARY OF THE INVENTION

Two forms of liquid-pourer according to the present invention will now be described, by way of example, with reference to the accompanying drawings, in which:

FIG. 1 is a perspective view from the front of a first of the two liquid-pourers according to the invention;

FIG. 2 is a sectional side elevation to an enlarged scale, of part of the liquid-pourer of FIG. 1;

FIG. 3 shows the liquid-pourer of FIG. 1 attached to a bottle;

FIG. 4 is a sectional side-elevation of the second liquid-pourer according to the invention; and FIG. 5 is illustrative of attachment of the liquid-pourer of FIG. 4 to a bottle.

Figure 1:
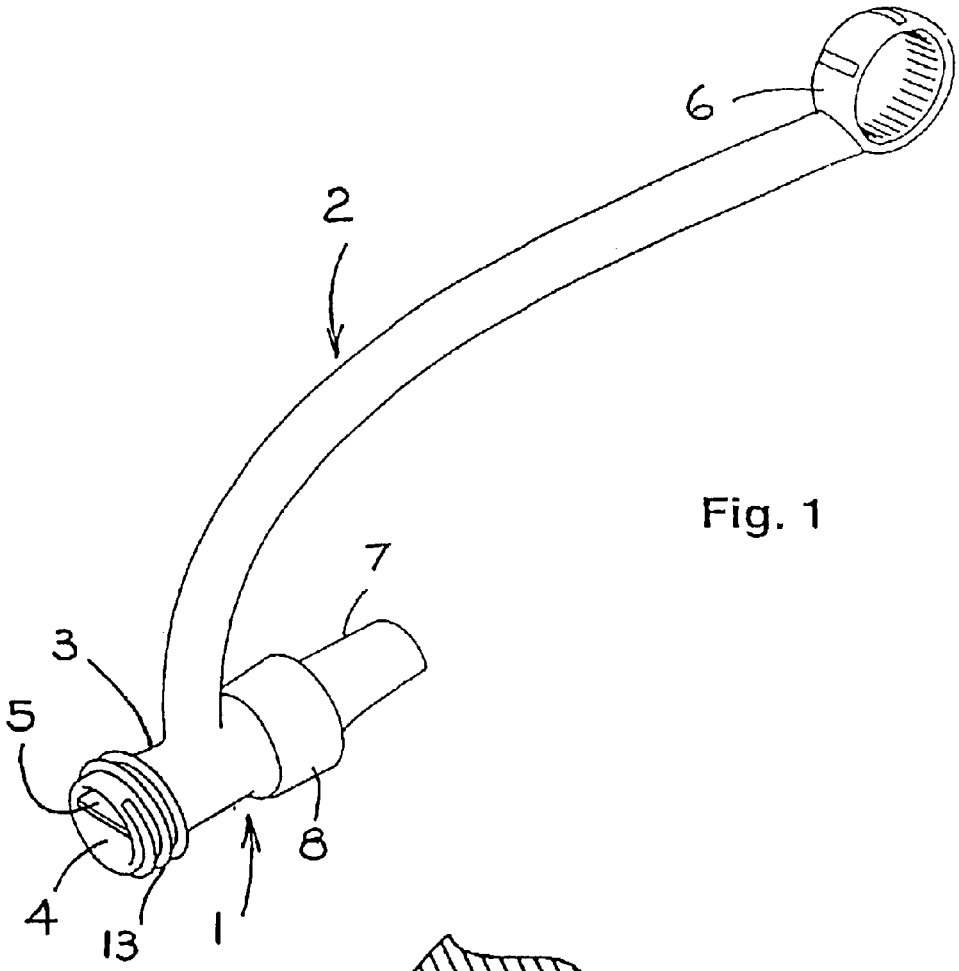
Referring to FIGS. 1 and 2, the first liquid-pourer is of moulded plastics and has a substantially cylindrical spout-portion 1 that is for coupling to the screw-threaded neck of a bottle. A handle-portion 2 for use in holding and guiding the pourer during use, is moulded integrally with the spout-portion 1 and extends both upwardly and rearwardly from a head-part 3 of it. Two passageways 4 and 5 of complementary segmental cross-section extend parallel to one another from front to rear of the spout-portion 1, the passageway 4 being for discharge of liquid from the bottle during pouring, whereas the passageway 5 is for admitting air to facilitate smoothness of that discharge. In this regard, the passageway 5 is located closer to the handle-portion 2 so as to be above the passageway 4 when the handle-portion 2 is held during pouring.

The handle-portion 2 extends upwardly and rearwardly from the portion 1 in a generous curve to terminate in an integral ring 6. The ring 6 is for use in retaining, by push fit, the cap of the bottle to which the pourer is attached. In this regard, once the cap of the bottle has been removed and located in the ring 6, the spout-portion 1 is located on the bottle. More particularly, a rearwardly-projecting spigot 7 of the spout-portion 1 is entered in the neck of the bottle to bring an internally-threaded collar 8 of the head-part 3 into engagement with the external screw-thread of the bottle-neck; the collar 8 is moulded separately from the rest of the pourer and is snapped, fixedly and water-tightly, onto the head-part 3. The pourer is then screwed onto the bottle-neck to hold it fast to the bottle as illustrated in FIG. 3.

Figure 3:
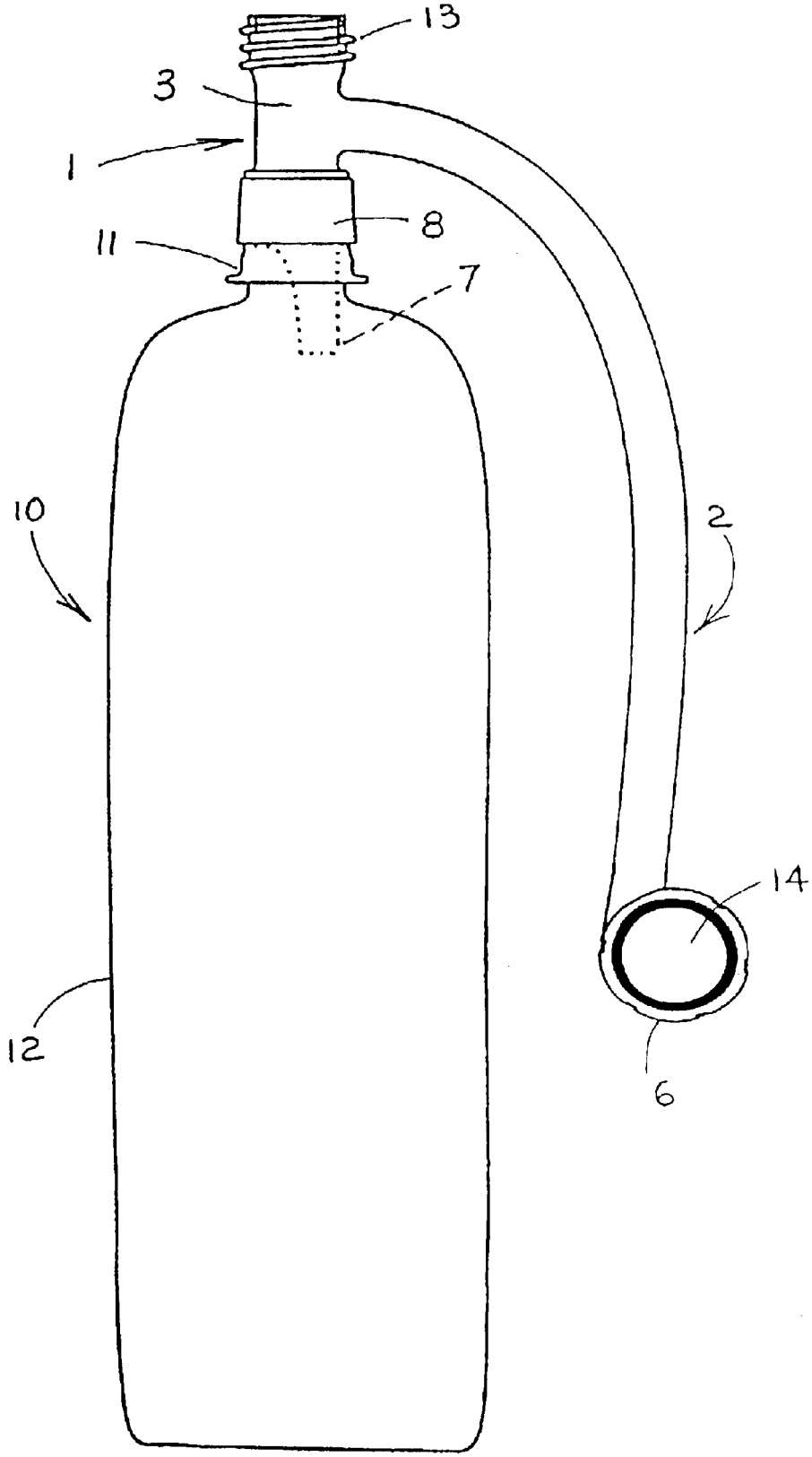

With the pourer screwed to a cylindrical (2 liter) bottle 10 as illustrated in FIG. 3, the handle-portion 2 extends outwardly from the bottle-neck 11 and down alongside, but spaced from, the cylindrical bottle-wall 12. The configuration of the handle-portion 2 is convenient for holding with one hand, whether carrying the bottle 10 upright or inclined away from the vertical for pouring. Whatever orientation of the bottle 10 is desired, and whatever its liquid content, there is in general a suitable location on the handle-portion 2 where it can be readily held comfortably by hand, with good balance.

Figure 2:
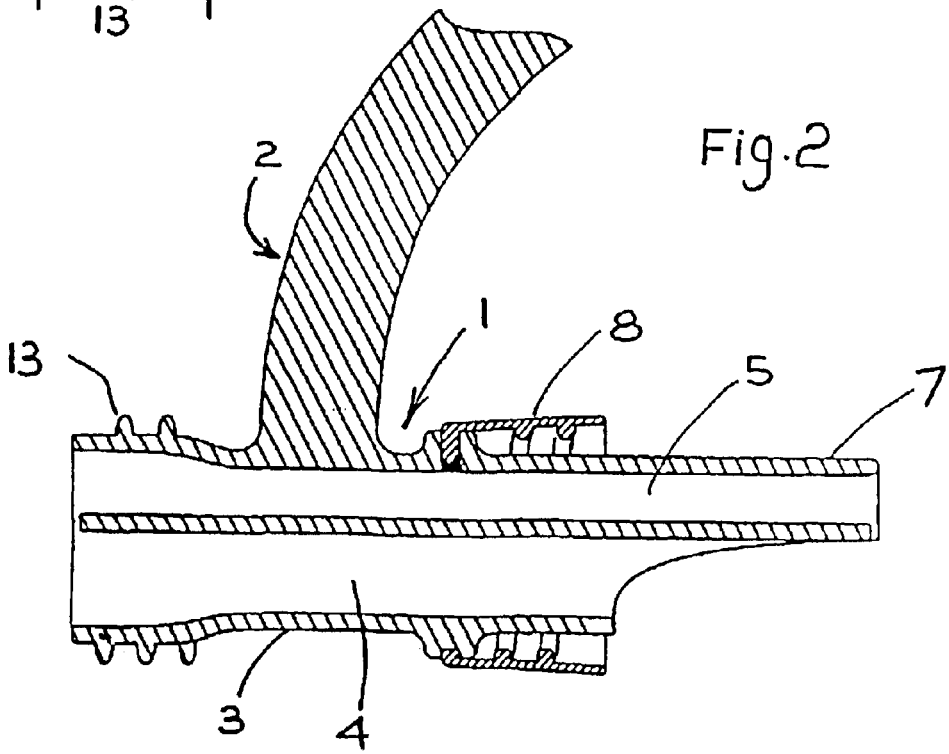

As illustrated in FIGS. 1 to 3, the spout-portion 1 has a screw-threaded nose 13 that allows, for example, a rose or other spray-producing accessory, to be coupled to the pourer for use during pouring. Moreover, it allows the bottle-cap 14 retained by the ring 6 (FIG. 3) to be removed and screwed onto the pourer to cap it and the bottle 10 as one while they remain attached to one another.

The pourer described above with reference to FIGS. 1 to 3 is attached to the bottle 10 by means of screw-threaded interengagement between the collar 8 and the bottle-neck 11. However, except when the bottle 10 is held vertical, most of its weight is taken by the spigot 7 entered in the neck 11 so attachment of the pourer to the bottle need not be heavy. An alternative form of the pourer in which attachment is by means of a clip, is illustrated in FIGS. 4 and 5.

Figure 4:
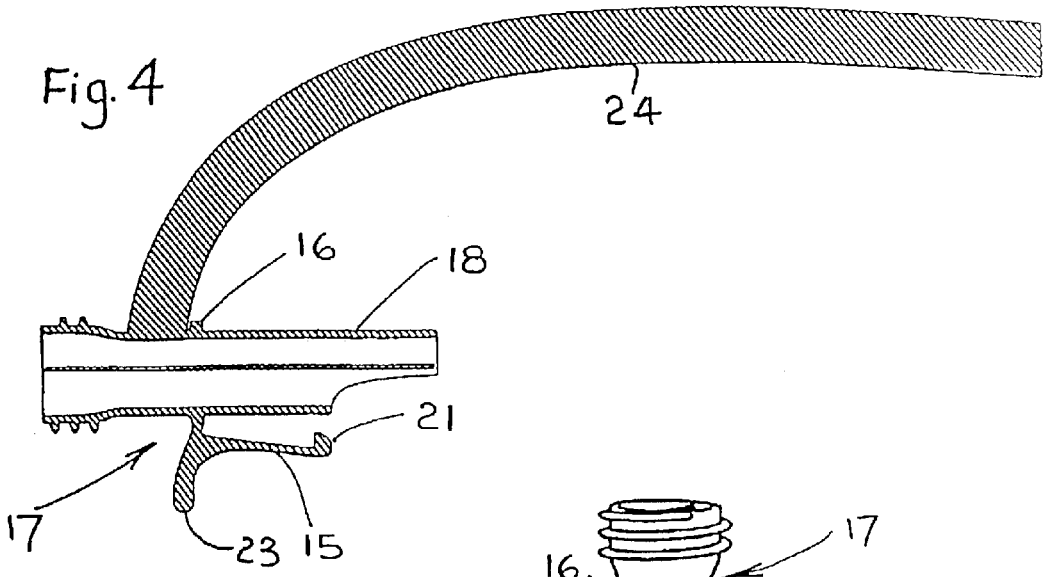
Figure 5:
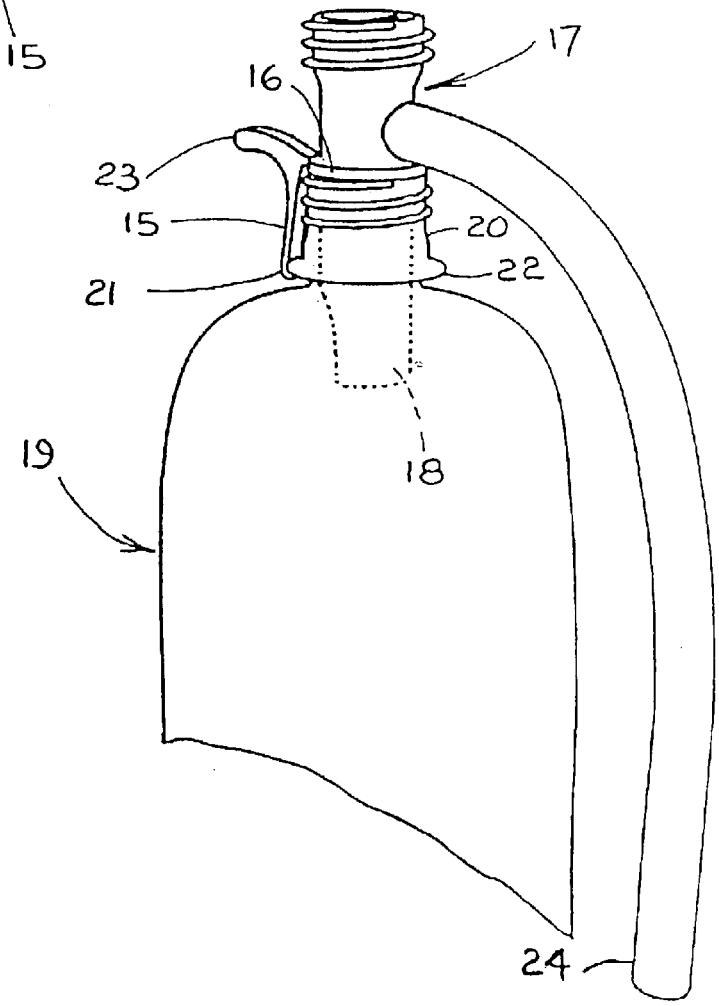

Referring to FIGS. 4 and 5, the liquid-pourer in this case is moulded as one piece with a clip element 15 attached to a circumferential rim 16 of the spout-portion 17. When the spigot 18 of the portion 17 is inserted in a bottle 19, the rim 16 is brought down onto the top of the bottle-neck 20 with the element 15 extending down the outside of the neck 20. The element 15 has a hook-end 21 and a degree of resilience in itself and in its attachment to the rim 16 by which the hook-end 21 snaps under the bottom rim 22 of the neck 20 as the rim 16 comes into abutment with the top of the neck 20, as illustrated in FIG. 5. This holds the rim 16 hard on the neck 20 to retain the pourer firmly and water-tightly attached to the bottle 19. Release of the pourer from attachment to the bottle 19 is achieved by pulling a lever-arm 23 of the clip-element 15 upwardly, so as to free the hook-end 21 from the rim 22.

The handle-portion 24 in this case is shown without provision for holding the cap of the bottle 19.

The liquid-pourers described above may be readily used for garden watering, and in this respect may be used for economy with a plastics bottle (usually transparent or semi-transparent) which previously contained bottled water or other soft drink and which otherwise would be discarded. Because of the ready availability of bottles of this nature, a number may first be filled with water, and the pourer attached to them in turn as each is emptied. A pourer of the form described above may also be used in the first place for dispensing the bottled-water or other soft drink for consumption, and indeed such a pourer may be adapted for attachment to the neck of a wine bottle and used for dispensing the wine therefrom.

What is claimed is:

1. A liquid-pourer for attachment to the neck of a bottle, comprising:

a spout-portion having a front end, a rear end for coupling to the bottle externally of the bottle-neck, and two elongate passageways extending parallel to one another between the rear and front ends of the spout-portion to open into and from the bottle, a first of the passageways being operable for discharging liquid when pouring from the bottle and a second of the passageways being operable for admitting air to the bottle when the second passageway is located above the first passageway during pouring; and an elongate handle-portion attached to the spout-portion to extend both upwardly and rearwardly to overlie the bottle when the second passageway is above the first passageway during pouring;

wherein the spout-portion has a spigot that projects from the rear end of the spout-portion for entering the bottle-neck for support of the bottle from within the bottle-neck during pouring, and the first and second passageways extend through the spigot from the front end of the spout-portion to open respectively from and into the bottle.

2. The liquid-pourer according to claim 1 wherein the spout-portion is generally cylindrical and the first and second passageways are of complementary segmental cross-section and extend parallel to one another lengthwise of the spout-portion.

3. The liquid-pourer according to claim 1 wherein the spout-portion and handle-portion are of molded plastics.

4. The liquid-pourer according to claim 3 wherein the spout-portion and handle-portion are molded integrally with one another.

5. The liquid-pourer according to claim 1 including means for screw-thread attachment of the spout-portion to the neck of the bottle.

6. The liquid-pourer according to claim 1 including a resilient clip-element for snap engagement under a portion of the neck of the bottle.

7. The liquid-pourer according to claim 1 attached to the neck of a bottle for pouring liquid from the bottle.

8. The liquid-pourer according to claim 1 including a collar attached to the spout-portion, the spigot projecting from the rear end of the spout portion through the collar, and the collar being internally screw-threaded for screw-threaded attachment to the neck of the bottle externally of the neck.

9. A liquid-pourer, for attachment to the neck of a bottle, comprising:

a spout-portion having a front end, a spigot projecting rearwardly from the front-end for location within the neck of the bottle for support of the bottle, and means for engagement with the neck externally of the bottle for holding the spout-portion fast to the bottle with the spigot within the neck; and an elongate handle-portion attached to the spout-portion to extend both upwardly and rearwardly with respect to the spout-portion; the spout-portion having a first elongate passageway that extends through the spigot to the front end for discharge of liquid from the front end in pouring from the bottle, and a second elongate passageway extending from the front end through the spigot for admitting air to the bottle from the front end, the second passageway extending parallel to the first passageway between the first passageway and the handle-portion.

10. The liquid-pourer according to claim 9 wherein the spout-portion is generally cylindrical and the first and second passageways are both of segmental cross-section, and the cross-sections of the first and second passageways are complementary to one another.

11. The liquid-pourer according to claim 9 wherein the spout-portion and handle-portion are of molded plastics.

12. The liquid-pourer according to claim 11 wherein the spout-portion and handle-portion are molded integrally with one another.

13. The liquid-pourer according to claim 9 wherein the mechanism for engagement with the neck externally of the bottle for holding the spout-portion fast to the bottle comprises a mechanism for screw-thread attachment of the spout-portion to the neck of the bottle.

14. The liquid-pourer according to claim 9 wherein the mechanism for engagement with the neck externally of the bottle for holding the spout-portion fast to the bottle, comprises a resilient clip-element for snap engagement under a portion of the neck of the bottle.

15. The combination comprising a bottle having a neck and a liquid-pourer attached to the neck for pouring liquid from the bottle, wherein the liquid-pourer comprises:

(a) a spout-portion having a front end, a spigot projecting rearwardly from the front-end to locate within the neck for support of the bottle during pouring, and means for engagement with the neck externally of the bottle for holding the spout-portion fast to the bottle with the spigot located within the neck; and (b) an elongate handle-portion attached to the spout-portion to extend both upwardly and rearwardly with respect to the bottle;

wherein the spout-portion has a first elongate passageway that extends through the spigot to the front end for discharge of liquid from the front end in pouring from the bottle, and a second elongate passageway extending from the front end through the spigot for admitting air to the bottle from the front end, the second passageway extending parallel to the first passageway between the first passageway and the handle-portion.

* * * * *